United States Patent [19]

Watanabe et al.

[11] 4,108,093

[45] Aug. 22, 1978

[54] PATTERN STITCHING SPEED CONTROL SYSTEM FOR ELECTRONIC SEWING MACHINES

[75] Inventors: Kazuo Watanabe, Hachioji; Tosiaki Kume, Tachikawa; Hideaki Takenoya, Hachioji; Toshihide Kakinuma, Tokyo; Hachiro Makabe, Fussa, all of Japan

[73] Assignee: Janome Sewing Machine Co. Ltd., Tokyo, Japan

[21] Appl. No.: 803,416

[22] Filed: Jun. 3, 1977

Related U.S. Application Data

[63] Continuation-in-part of Ser. No. 737,084, Oct. 29, 1976, abandoned.

[51] Int. Cl.[2] ..... D05B 3/02; D05B 69/18

[52] U.S. Cl. ..... 112/158 E; 318/305; 318/342; 318/348; 112/220

[58] Field of Search ..... 112/158 E, 220, 221, 112/277, 121.11, 121.12; 318/305, 163, 342, 348, 569, 571

[56] References Cited

U.S. PATENT DOCUMENTS

| | | | |
|---|---|---|---|
| 3,319,591 | 5/1967 | Hamlett | 112/220 |
| 3,493,832 | 2/1970 | Kay | 318/305 X |
| 3,612,969 | 10/1971 | Cockroft | 318/163 |
| 3,789,783 | 2/1974 | Cook et al. | 112/220 |
| 3,872,808 | 3/1975 | Wurst | 112/158 E |

*Primary Examiner*—Peter Nerbun
*Attorney, Agent, or Firm*—Michael J. Striker

[57] ABSTRACT

A drive motor drives a reciprocating sewing needle. A static memory has lateral-control-signal outputs at which it furnishes signals indicating how much the needle should be laterally shifted for each stitch in a selected pattern, and feed-control-signal outputs at which it furnishes signals indicating how much a work feeding device should feed the work for each stitch of the pattern. An addressing circuit response to a pattern selector applies to the static memory a repeated sequence of address signals, causing the memory to produce repeated sequences of lateral-control and feed-control signals at its outputs. The first address signal in any of the repeated sequences of address signals causes the static memory to produce at its output a first lateral-control signal constituting a maximum-speed-establishment signal, and a first feed-control signal constituting a maximum-permissible-speed signal. A latch receives the feed-control signals but does not in general register them, except when activated. A detector receives the lateral-control signals, and in response to the maximum-speed-establishment signal activates the latch which then registers the maximum-permissible-speed signal. A motor speed limiter limits the speed of the drive motor in dependence upon the signal registered by the latch.

11 Claims, 7 Drawing Figures

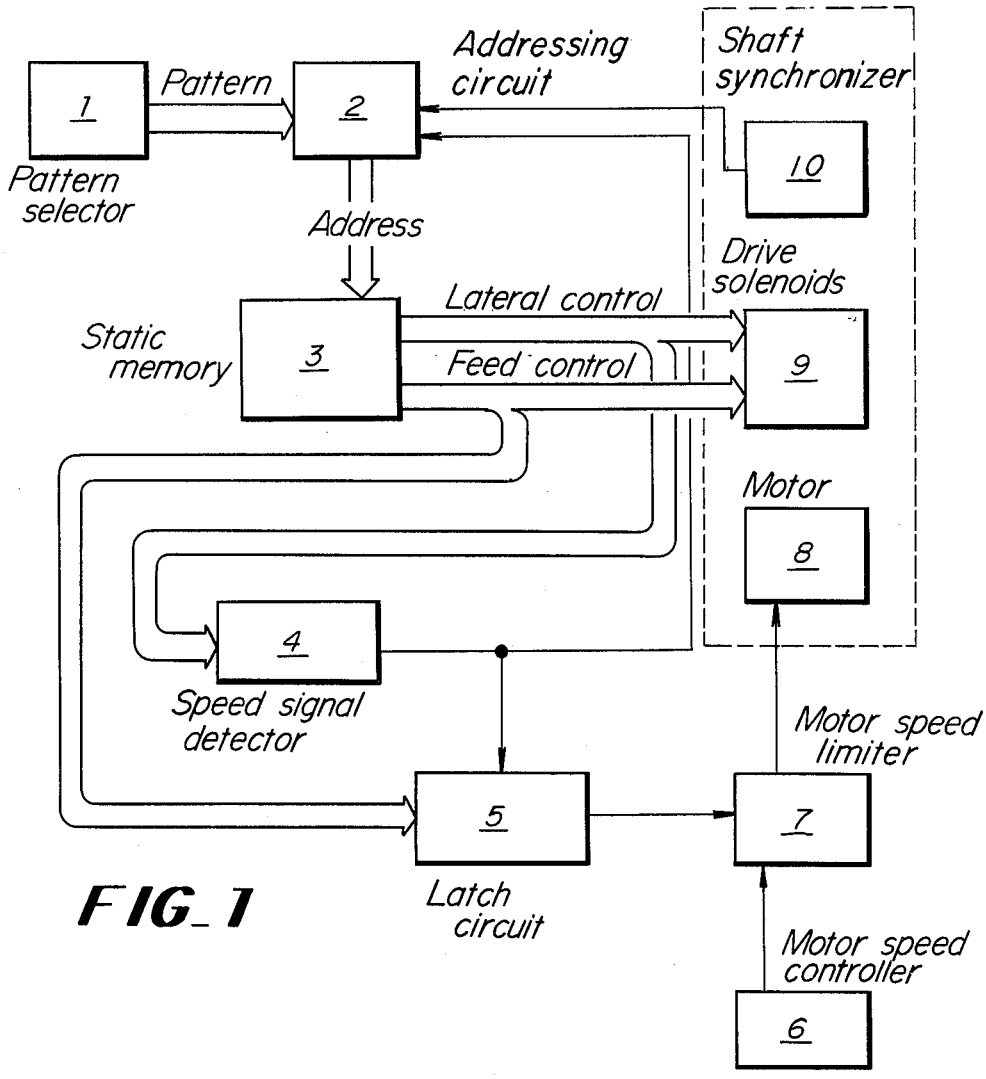
FIG_1
FIG_2
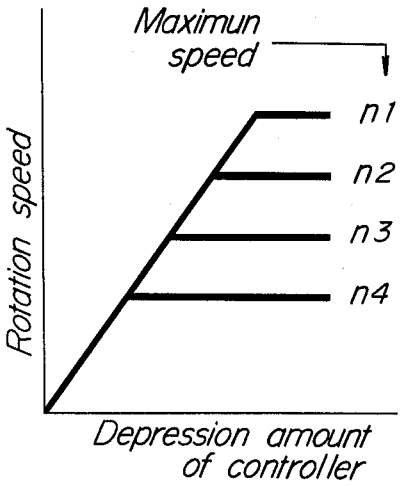
FIG_3
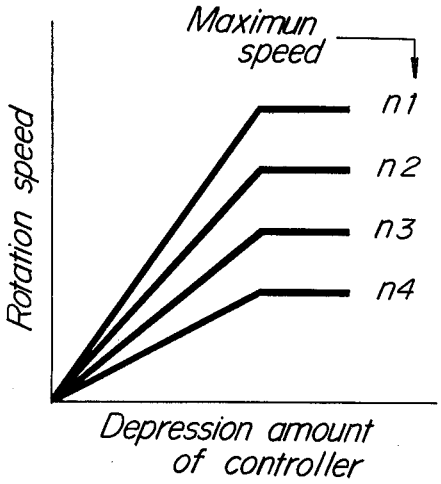

5
LATCH
+
PA
POWER AMPLIF
R
P
VS
D1
8
ES1
MOTOR
ES2
ES3
ES4
VR1
VR2
VR3
VR4
6
FOOT PEDAL SPEED CONTROLLER

5
LATCH
+
R1
ES1
PA
VS
100%
R2
ES2
POWER AMPLIFIER
P
ES3
R3
0%
MOTOR
R4
ES4
8
FOOT PEDAL SPEED CONTROLLER
6

P1
P2
P3
P4
1
2
OR
OR1
MM1
ONE SHOT
10
SHAFT SYNCH
ENCODER
E
BINARY COUNTER
BC
RESET
AND
A1
OR
OR2
AND
A2
STATIC MEMORY
FEED
LATERAL
3
9
LATERAL CONTROL SOLENOIDS 101-115
FEED CONTROL SOLENOIDS 111-115
4
AND
A3
DELAY
TD
7
8
LATCH
SPEED LIMITER
MOTOR
5
6
FOOT PEDAL SPEED CONTROLLER

PATTERN STITCHING SPEED CONTROL SYSTEM FOR ELECTRONIC SEWING MACHINES

CROSS-REFERENCE TO RELATED APPLICATION

The present application is a continuation-in-part of prior copending application Ser. No. 737,084, filed Oct. 29, 1976, now abandoned.

BACKGROUND OF THE INVENTION

The invention relates to sewing machines of the type provided with pattern selectors. When a stitching pattern is selected, the machine repeatedly sews the stitching pattern. The pattern information for the different patterns is usually stored in an electronic storage device.

It has been found that depending upon the configuration of the stitching pattern, certain respective speeds of the drive motor of the sewing machine should not be exceeded, to avoid the production of deformed stitching patterns.

In general, the limiting of the speed of operation of the sewing machine motor by means of the operator-activated speed controller, e.g. footpedal controller, is no solution to this problem, because of the excessive concentration which would be required on the part of the operator.

SUMMARY OF THE INVENTION

It is a broad object of the invention to provide a sewing machine with automatic stitching-pattern sewing capability with a built-in speed-limiting action which automatically limits the speed of operation of the machine motor in dependence upon which stitching pattern has been selected.

According to the broadest concept of the invention, this object is achieved by using a static memory which stores both pattern information representing the stitches in a plurality of different multi-stitch stitching patterns and also motor-speed-control information for the different stitching patterns. The pattern information is transmitted to means for controlling the lateral shifting of the sewing needle of the machine and is also transmitted to means for controlling the feeding of work towards and away from the sewing needle. The motor-control information is transmitted to motor-control means for controlling the speed of operation of the motor in automatic dependence upon the pattern selection.

According to a preferred embodiment of the invention, the stored pattern information consists of lateral-control signals representative of the lateral shift to be imparted to the sewing needle and feed-control signals representative of the work feed movement to be effected by the work-feeding means of the machine. The static memory has lateral-control-signal outputs and feed-control-signal outputs at which the aforementioned control signals appear, in predetermined sequences, under the control of an addressing circuit for the static memory. The addressing circuit is responsive to the pattern selection. For the selected pattern, the addressing circuit applies to the static memory a repeated sequence of address signals, producing at the output of the static memory corresponding sequences of lateral-control signals and feed-control signals. These control signals are continually applied to means for controlling the lateral needle movement and the work feed movement.

Additionally, however, the lateral-control signals are continually applied to a detector, and the feed-control signals are continually applied to a latch. The first address signal in the sequence of address signals associated with any pattern causes the static memory to produce at its lateral-control-signal outputs a first lateral-control signal, and at its feed-control-signal outputs a first feed-control signal. The first lateral-control signal has a predetermined value and constitutes a maximum-speed-establishment signal, indicating that the maximum permissible motor speed for the selected pattern is going to be established. The first feed-control signals has one of a plurality of different predetermined values, associated with the different patterns, and constitutes a maximum-permissible-speed signal indicating what the maximum permissible motor speed for the selected pattern actually is.

The aforementioned detector responds to the maximum-speed-establishment signal by activating the latch, whereupon the latter registers the maximum-permissible-speed signal. The latter signal is then applied, during the entire course of the sequence of lateral-control and feed-control signals, to a speed-limiter which automatically limits the drive motor speed. This maximum speed establishment occurs once per address-signal sequence, in the preferred embodiment. If an operator-controlled speed elector is being used, the speed limiter either overrides the speed selector at the higher-speed settings of the latter or modifies the motor-speed/selector-setting relationship of the selector, in correspondence to the maximum-permissible-speed signal.

Alternative embodiments are discussed below in the detailed description.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is an information-flow diagram illustrating one embodiment of the system concept of the present invention;

FIG. 2 depicts one speed-limiting action;

FIG. 3 depicts a speed limiting action;

DESCRIPTION OF THE PREFERRED EMBODIMENTS

Figure 2A:
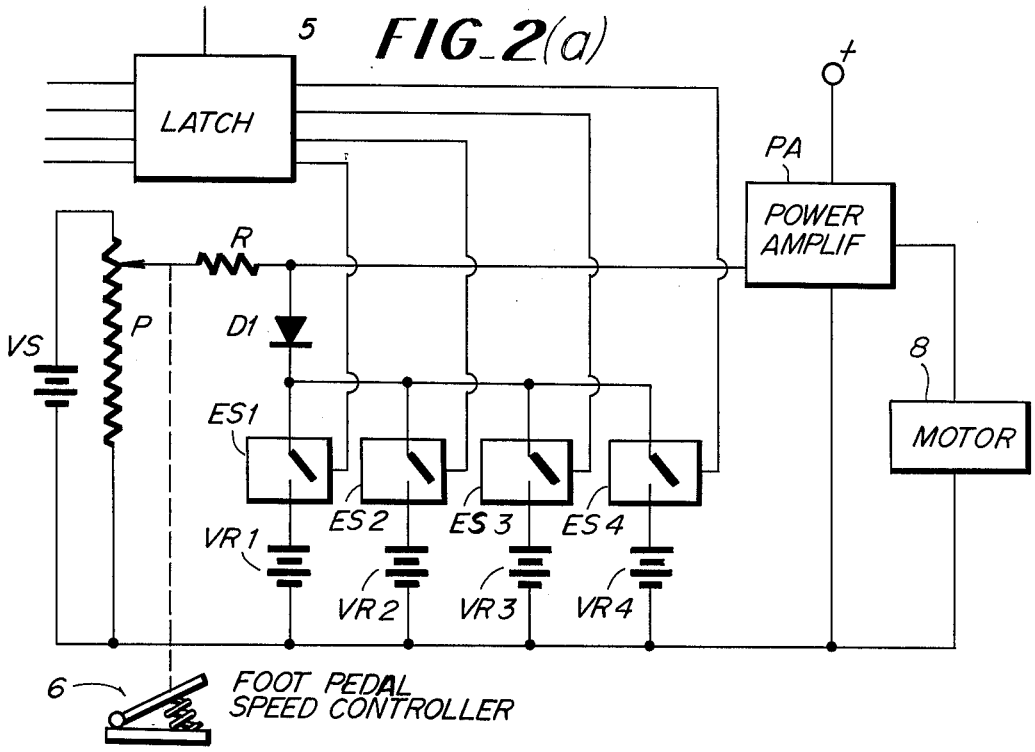
FIG. 2*a* depicts a speed limiter embodying the action illustrated in FIG. 2.

FIG. 1 is a schematic representation of the overall flow of information and of the operational relationships of a sewing machine provided with the pattern-dependent speed limiting system of the present invention.

Numeral 1 denotes a pattern selector comprised of pattern selector switches selectable by the user of the sewing machine for establishing the pattern to be sewn.

Numeral 2 denotes an addressing circuit, and numeral 3 denotes a static memory addressed by addressing circuit 2. Depending upon which pattern has been selected, addressing circuit 2 repeatedly addresses a predetermined respective sequence of storage units in the static memory 3. The static memory 3 furnishes at its outputs two sets of control signals. The first set of control signals determines the direction and amplitude of lateral movement of the sewing machine needle. The second set of control signals determines the direction and amplitude of feed movement of the clotch feeding device of the sewing machine. These lateral-control and feed-control signals are applied to respective sets of drive solenoids 9, discussed in greater detail below.

Numeral 10 denotes a shaft synchronizer. Shaft synchronizer 10 is operative for applying to addressing circuit 2 clock pulses synchronized with the rotation of the drive shaft of the sewing machine. Numeral 8 denotes the prime motor of the sewing machine. Numeral 11 generally denotes the main electromechanical components of the sewing machine.

Numeral 6 denotes a motor speed controller, for example a conventional footpedal speed controller. Numeral 7 denotes a motor speed limiting circuit which cooperates with speed controller 6 for limting the maximum motor speed selectable by the controller 6 in dependence upon the pattern being sewn.

Numeral 4 denotes a speed signal detector circuit, and numeral 5 denotes a latch circuit. Speed signal detector 4 receives the lateral-control signals furnished by static memory 3, whereas latch circuit 5 receives feed-control signals from static memory 3. The output of speed signal detector 4 is connected to the control input of the latch circuit 5 and is also connected, along with the output of shaft synchronizer 10, to the clock pulse input of the addressing circuit 2.

Although speed signal detector 4 receives all the lateral-control signals furnished from the static memory 3 to the drive solenoids 9, speed signal detector 4 is in general not responsive to the lateral-control signals. Likewise, although latch circuit 5 receives feed-control signals furnished from static memory 3 to the drive solenoids 9, latch circuit 5 is in general not responsive to the feed-control signals.

In the illustrated embodiment, speed signal detector 4 is responsive to only one particular lateral-control signal out of the total number of distinguishable lateral-control signals which static memory 3 is capable of furnishing. This particular lateral-control signal is utilized as a maximum-speed-establishment control signal. When speed signal detector 4 receives the maximum-speed-establishment control signal, it produces an output signal which is applied to the control input of latch circuit 5. Thereupon, latch 5 registers the feed-control signal being furnished at that time by the static memory 3 to the drive solenoids 9.

The value of the feed-control signal being furnished by static memory 3 at the time that the latter is also furnishing the maximum-speed-establishing signal is indicative of the maximum permissible motor speed for the selected sewing pattern. When latch circuit 5 is enabled by speed signal detector 4, the feed-control signal applied to the input of latch circuit 5 (and now constituting the maximum-permissible-speed control signal) is transmitted to the output of latch circuit 5 and is furnished to the control input of the motor speed limiting circuit persistently, i.e., until such time as the speed signal detector 4 again enables the latch circuit 5. The maximum-permissible-speed signal thereafter causes the motor speed limiter 7 to limit the motor speed selectable by speed controller 6 to the maximum permissible value in question.

When speed signal detector 4 generates an output signal and enables latch circuit 5, it also transmits that output signal to the clock signal input of the addressing circuit 2, so that the addressing counter therein will be advanced to the next count.

The operation of the system of FIG. 1 is as follows:

The user of the sewing machine activates the pattern selector 1 to select one of the available sewing patterns. This determines which one of several predetermined sequences of address signals will be repeatedly furnished by addressing circuit 2 to the static memory 3. In general, the progression from one to the next address signal occurs in synchronism with the operation of the shaft synchronizer 10. However, the first address signal furnished to static memory 3 is independent of the operation of shaft synchronizer 10. Instead, the first address signal is furnished to static memory 3 in immediate response to activation of the pattern selector 1 for a new pattern.

When static memory 3 receives this first address signal in the address-signal sequence associated with the selected pattern, the information registered in the storage unit in memory 3 associated with the first address signal is transmitted to the outputs of the static memory 3. The static-memory storage unit associated with the first address signal stores information indicating that the maximum permissible speed for the selected pattern is now to be established; this information is furnished at the lateral-control-signal outputs of static memory 3. The static-memory storage unit associated with the first address signal also stores information indicative of what the maximum permissible speed for the selected pattern actually is; this information is furnished at the feed-control-signal outputs of static memory 3.

Thus, when the pattern selector 1 is activated, to select a new pattern, there appears at the lateral-control-signal outputs of static memory 3 the maximum-speed-establishment signal, whereas there appears at the feed-control-signal outputs of static memory 3 the actual maximum-permissible-speed signal.

For example, the static memory 3 may have five outputs for furnishing lateral control signals and five further outputs for furnishing feed control signals. In that event, the lateral-control signals could have any value from 00000 to 11111, and likewise, the feed-control signals could have any value from 00000 to 11111. Of the values possible for the lateral-control signals, one value, for example 11111, is relegated for exclusive use as the maximum-speed-establishment signal — i.e., the signal which indicates to detector 4 that the maximum permissible speed of motor 8 for the selected pattern is now going to be established.

In contrast, it is not necessary that any particular values of the feed-control signals be reserved for exclusive use as the maximum-permissible-speed signal — i.e., the signal which indicates what the maximum permissible speed actually is to be.

This can be expressed in other words. Of the thirty-two possible values of the lateral-control signal, one value (e.g., 11111) is reserved for exclusive use as the maximum-speed-establishment signal to which detector 4 responds, whereas the other thirty-one possible values of the lateral-control signal are used to determine the direction and amplitude of lateral needle movement. In contrast, all 32 of the values possible for the feed-control signal can be utilized for controlling the direction and amplitude of feed movement, but with some of these values additionally being used for the maximum-permissible-speed signal.

To summarize what has been stated so far:

When pattern selector 1 is activated to select a new sewing pattern, the storage unit in memory 3 associated with the first address signal for that pattern is immediately addressed. That storage unit registers, firstly, the maximum-speed-establishment signal (e.g., 11111), which is transmitted to the lateral-control-signal outputs of static memory 3. That storage unit registers, secondly, the maximum-permissible speed signal, which is transmitted to the feed-control-signal outputs of memory 3. The maximum-speed-establishment signal (11111) is detected by detector 4, and detector 4 in response thereto enables latch 5. Latch 5 thereupon registers at its outputs the maximum-permissible-speed signal applied to its input.

When detector 4 thusly detects the maximum-speed-establishment signal (11111) it additionally applies a signal to the clock-signal input of addressing circuit 2. In response, addressing circuit 2 now furnishes memory 3 the second address signal associated with the selected pattern, and thus the second lateral-control and the second feed-control signals appear at the outputs of memory 3. The second lateral-control signal is not the maximum-speed-establishment signal (i.e., not 11111), and therefore detector 4 no longer enables latch 5. As a result, the first feed-control signal, already registered at the outputs of latch 5 and constituting the maximum-permissible-speed signal, persists at the outputs of latch 5; the second feed-control signal has no effect upon latch 5.

Meanwhile, the second lateral-control signal and the second feed-control signal are applied to drive solenoids 9. At this point, it should be noted that, previously, the first lateral-control signal (constituting the maximum-speed-establishment signal) and the first feed-control signal (constituting the maximum-permissible-speed signal) were of course applied to the drive solenoids 9. However, these first control signals were applied to the drive solenoids 9 for a time interval negligible compared to the response time of the drive solenoids; as a result, the use of the first lateral-control and feed-control signals for setting the maximum permissible speed does not interfere with proper setting of the pattern.

In contrast, the second lateral-control signal and the second feed-control signal are applied to drive solenoids 9 for a much longer time, and the drive solenoids become energized to set the electromechanical components of the lateral needle control and feed devices into readiness for sewing the first stitch of the selected pattern.

When, now, the operator of the machine activates the motor speed controller 6, for example by depressing a footpedal speed controller, the sewing machine motor 8 commences to turn and the actual stitches of the selected sewing pattern are produced in succession. During sewing of the pattern proper, the clock pulses for driving the addressing circuit are furnished by the shaft synchronizer 10. The addressing circuit is driven by the speed signal detector 4 only once — to cause the addressing circuit to advance from the first address signal to the second address signal — and not thereafter.

As the operator of the machine depresses the motor speed controller more and more, the speed of sewing machine motor 8 rises correspondingly. When the footpedal speed controller is depressed to an extent corresponding to the maximum permissible speed, the speed-limiting circuit 7, under the control of the maximum-permissible-speed signal furnished thereto by latch circuit 5, prevents further motor speed increases, even if the operator continues to depress the footpedal speed controller.

Sewing of the selected pattern is performed repeatedly, for as long as the operator keeps the footpedal speed controller depressed. If the footpedal speed controller is released, the motor stops. If the operator than activates pattern selector 1 to select a different pattern, the sequence of operations described above is repeated, but a different maximum-permissible-speed signal will be registered by latch circuit 5.

FIGS. 2 and 3 depict two different speed-limiting possibilities. In FIG. 2 the speed-limiting action for four different patterns is indicated. As the footpedal controller is depressed more and more, the motor speed rises correspondingly, until the speed corresponding to the maximum-permissible-speed signal for the selected pattern is reached, whereupon further depression of the footpedal controller results in no further motor speed increase. In FIG. 2, the maximum speeds for the different selectable patterns are reached at different respective degrees of footpedal controller depression. If the maximum permissible for the different patterns differ greatly, this may not be desirable, because then for the pattern associated with the lowest maximum permissible speed (*n*4) the range of effective depression movement of the footpedal controller is considerably less than with the pattern associated with the highest maximum permissible speed (*n*1). This may, in some cases, be uncomfortable to the operator of the sewing machine.

Accordingly, FIG. 3 depicts an alternative speed-limiting action in which the amount of footpedal controller depression corresponding to maximum permissible speed is the same for all the patterns. In this way, depression of the footpedal controller half way, for example, will result in the same fraction of maximum permissible speed, no matter which pattern has been selected.

Figure 3A:
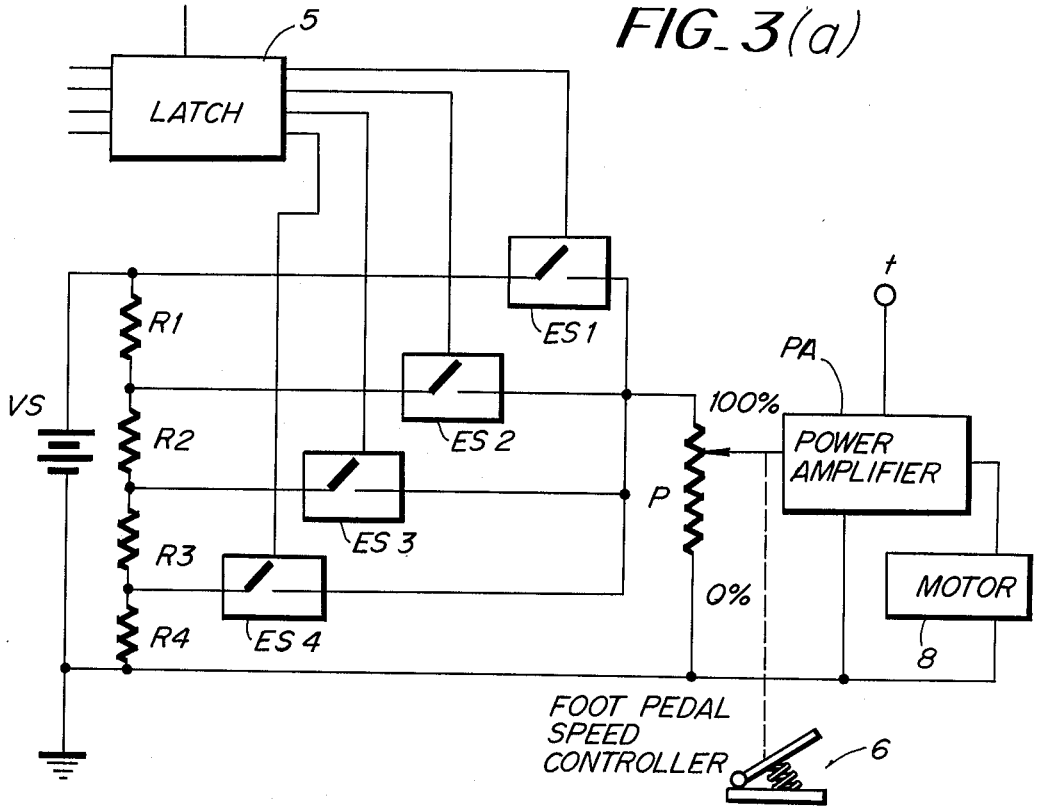
FIG. 3*a* depicts a speed limiter embodying the action illustrated in FIG. 3.
Figure 4:
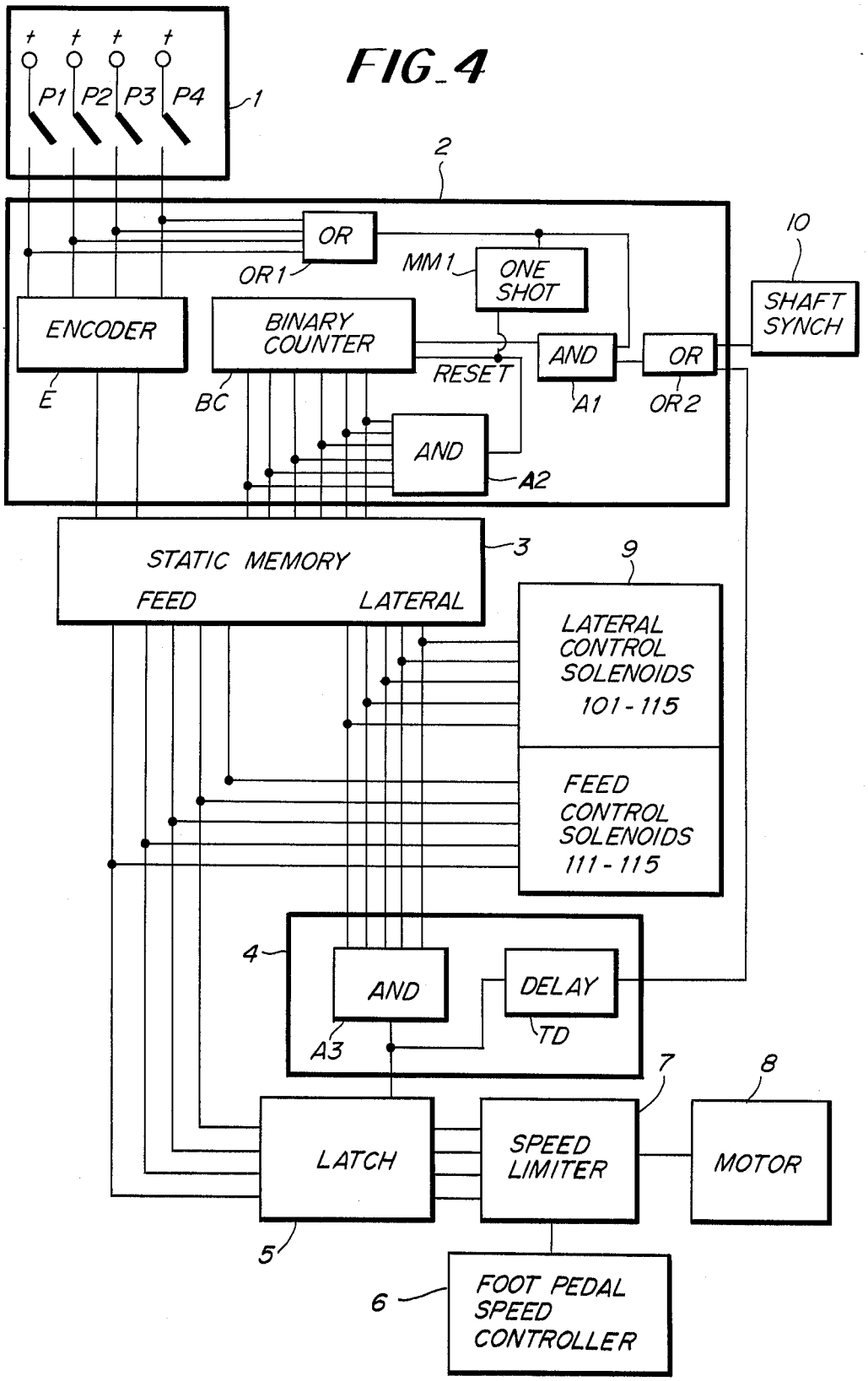
FIG. 4 depicts an exemplary circuit illustrative of the system concept embodiment illustrated in FIG. 1.
Figure 5:
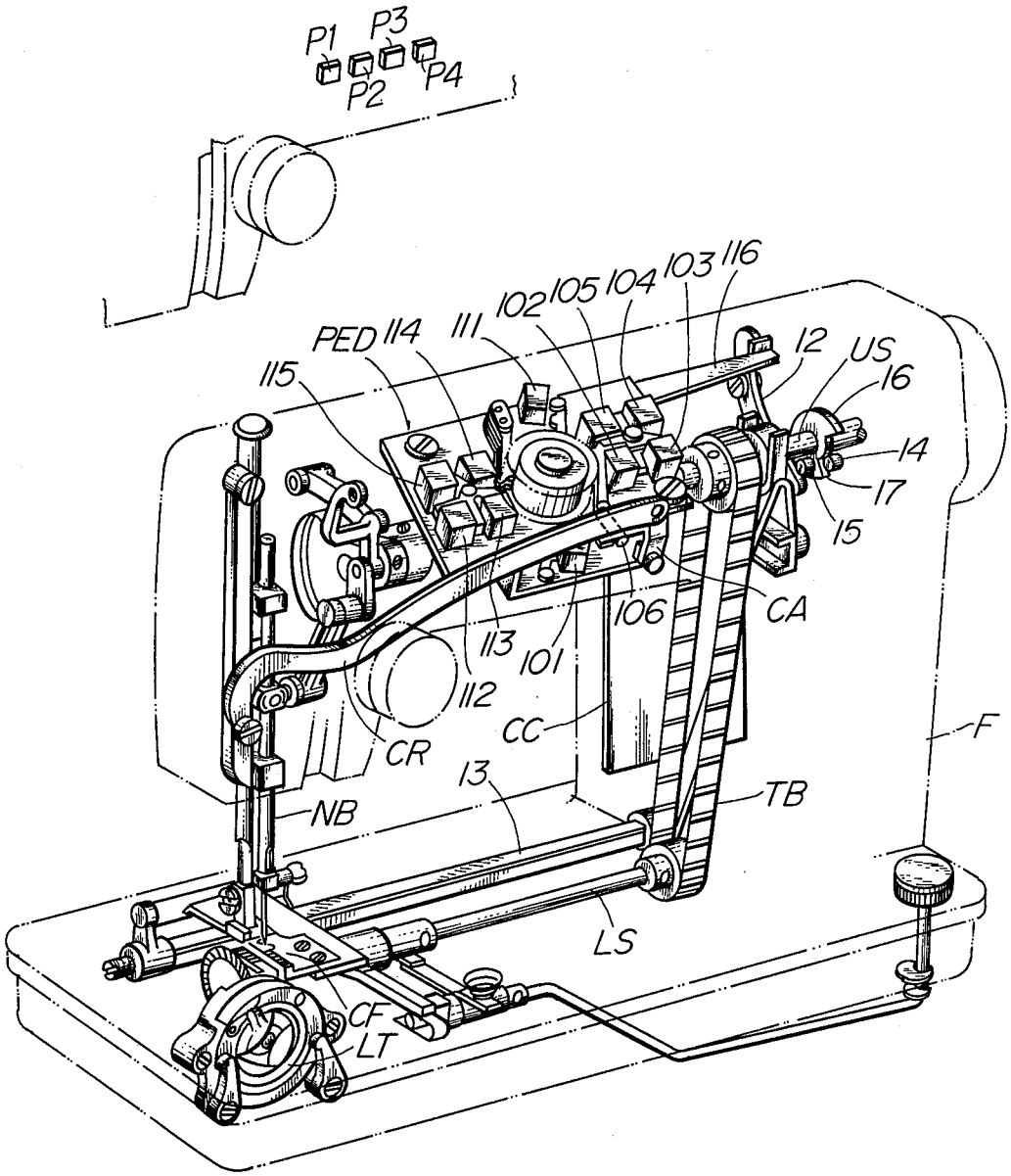
FIG. 5 depicts some details of the sewing machine structural context in which the patterning circuitry is utilized.

FIG. 4 depicts in simplified schematic form a circuit embodying the system concepts explained above with respect to FIG. 1, but without details of the construction of the speed limiter 7. FIGS. 2*a* and 3*a* depict two alternative constructions for the speed limiter 7, corresponding to the speed-limiting actions graphically depicted in FIGS. 2 and 3. FIG. 5 depicts portions of the structure of a sewing machine in which the system concepts of the invention can be utilized.

Referring first to FIG. 5, F denotes the frame of the sewing machine. US denotes the upper shaft of the machine. LS is the lower shaft of the machine. NB denotes a needle bar. CF a clotch feeding device, and LT a loop taker. When upper shaft US is rotated by the motor of the sewing machine, needle bar NB is reciprocated vertically by means of a crank mechanism and lower shaft LS is rotated via a timing belt TB to effect rotation of the loop taker LT.

PFD denotes generally a pattern forming device operative for driving an output arm 106 to effect oscillation of a control arm CA. The swinging movement of control arm CA effects lateral reciprocation of a connecting rod CR connected at one end to control arm CA and at its other end to the supporting frame of the swingable needle bar. Thus, the needle bar NB and the needle accommodated therein are caused to swing laterally in direction transverse to the direction of relative movement between the cloth and the cloth feeding device.

The pattern forming device PFD additionally drives a feed control arm 116, causing the latter to effect swinging movement of a regulating arm 12 and thereby impart a feeding movement to the cloth feeding device CF through the intermediary of a feed control rod 13.

The pattern forming device PFD controls needle position or direction and the amplitude of the cloth feeding movement associated with each stitch under the control of a stitch control signal generated by a control circuit CC in a manner described below. The shaft synchronizer 10 of FIG. 1 here comprises a phototransistor 14 which receives light from a light-emitting diode 15 through a notch 17 in a light shield 16 mounted on the upper shaft US of the machine and generates a synchronizing signal synchronized with the rotation of the upper shaft US. This synchronizing signal is applied to the control circuit CC.

Pattern selector switches P1–P4 are provided on the front side of the frame of the sewing machine, and a desired pattern is selected by activating the corresponding selector switch. The pattern forming device PFD includes an adder (not shown) and driving solenoids 101–105 for controlling the lateral movement of the needle and a further adding device which includes a further adder (not shown) driving further solenoids 111–115 for controlling the operation of the cloth feeder. These adders are utilized in the imparting of movement to the zig-zag control arm CA and the feed control arm 12 via the intermediary of the respective output arms 106, 116. The two adder devices respectively control the energization of the driving solenoids 101–105 and 111–115. Depending upon the combination of solenoids which are energized, any of a plurality of displacement distances standing in the ratio of 1 : 2 : 4 : 8 : 16 can be selected and a corresponding movement imparted to a respective one of the output arms 106, 116. Moreover, these component displacement distances can be superimposed in any desired combination, making for composite displacement distances of anywhere from zero to 31 units.

Referring now to FIG. 4, there is depicted an exemplary control circuit embodying the system concepts explained above with respect to FIG. 1.

Pattern selector 1 is here essentially comprised of the four pattern selector switches P1, P2, P3, P4, shown in FIG. 5.

Addressing circuit 2 of FIG. 1 is essentially comprised of a binary counter BC serving as an addressing counter. Addressing circuit 2 additionally includes an encoder E having four inputs connected to respective ones of the pattern selector switches P1–P4 and having two outputs connected to the left two address-signal inputs of the static memory 3. The six outputs of binary counter BC are connected to respective ones of the right six address-signal inputs of memory 3. An OR-gate OR1 has four inputs, connected to respective ones of the four selector switches P1–P4. The output of OR-gate OR1 is connected via a one-shot multivibrator (monostable multivibrator) MM1 to the reset input of binary counter BC. The output of OR-gate OR1 is also connected to the upper input of an AND-gate A1 whose output is connected to the clock signal input of the binary counter BC. The lower input of AND-gate A1 is connected to the output of an OR-gate OR2 whose upper input is connected to the output of the shaft synchronizer 10. A second AND-gate A2 has six inputs connected to respective ones of the six outputs of binary counter BC, and has an output connected to the reset input of the binary counter.

The static memory 3 in FIG. 4 has eight address-signal inputs and ten control-signal outputs, the left five constituting feed-control-signal outputs, the right five constituting lateral-control-signal outputs. The eight-input memory 3 is comprised of $2^8 = 256$ individually addressable information-storage units. Each information-storage unit is capable of simultaneously storing ten different signals (each having the value 0 or 1), corresponding to the ten outputs of the memory.

The five lateral-control-signal outputs of memory 3 are connected to respective ones of the driving solenoids 101–105 of the unit 9, whereas the five feed-control-signal outputs of memory 3 are connected to respective ones of the driving solenoids 111–115 of the unit 9.

The speed signal detector 4 is here comprised of an AND-gate A3 having five inputs connected to respective ones of the five lateral-control-signal outputs of the memory 3. Detector 4 additionally includes a time-delay stage TD whose input is connected to the output of AND-gate A3, and whose output is connected to the lower input of OR-gate OR2 of addressing circuit 2.

The latch circuit 5 of FIG. 1 is here a four-input/-four-output latch circuit of conventional design, having a control input connected to the output of AND-gate A3, and having its four inputs connected to a respective four of the five feed-control-signal outputs of static memory 3. The four outputs of latch 5 are connected to respective ones of the four inputs of a speed limiter 7. The output of speed limiter 7 is connected to motor 8. Details of speed limiter 7 and its cooperation with footpedal speed controller 6 and motor 8 are shown in FIGS. 2*a* and 2*b*, and discussed further below.

The circuit of FIG. 4 operates as follows:

The operator of the sewing machine selects one of four patterns by closing the respective switch P1, P2, P3 or P4. This is done by depressing the corresponding pushbutton shown in FIG. 5; the associated switch in FIG. 4 stays closed until the respective pushbutton is depressed a second time or until a different one of the pushbuttons is depressed.

When any of selector switches P1-P4 is closed, a "1" signal is applied to the input of OR1 and transmitted to the output thereof to trigger the monostable multivibrator MM1. The brief output pulse from MM1 is applied to binary counter BC, and resets the latter to the count 000000. As a result, the right six address-signal inputs of static memory 3 all receive "0" signals.

The just-mentioned "1" signal at the output or OR1 is additionally applied to the upper input of AND-gate A1, thereby enabling A1 for the transmission of clock signals to the clock-signal input of binary counter BC.

Meanwhile, closing of the selected one of switches P1-P4 has caused a positive potential to be applied to a corresponding one of the four inputs of the encoder E, representing a choice of pattern #1, #2, #3, or #4. Encoder E responds by producing at its output a corresponding two-bit signal: 00, 01, 10 or 11, for pattern #1, #2, #3, or #4, respectively. This two-bit pattern-indicating signal is applied to the left two address-signal inputs of static memory 3.

Accordingly, when one of switches P1-P4 is closed, the eight-bit address signal applied to the eight-address-signal inputs of memory 3 will be 00000000, 01000000, 10000000 or 11000000, depending upon whether pattern #1, #2, #3, or #4 has been selected. This eight-bit address signal constitutes the first address signal in the sequence of address signals associated with the chosen pattern.

With the application of this first address signal to the static memory 3, the latter produces at its outputs the first five-bit lateral-control signal and the first five-bit feed-control signal. No matter which pattern has been selected, the first lateral-control signal will be 11111, constituting the maximum-speed-establishment signal, indicating that the maximum permissible speed for the chosen pattern is now going to be established.

The maximum-speed-establishment signal (11111) is applied to the AND-gate A3, which responds by applying a "1" signal to the control input of latch 5. As a result, latch 5 registers at its outputs four of the bits of the first five-bit feed-control signal from memory 3. This first feed-control signal has a value indicative of the maximum speed of motor 8 permissible for the selected pattern. In the illustrated embodiment, any code can be used for representing the maximum permissible speed, for example 00001, 00010, 00100, 01000 for maximum permissible speeds *n*1, *n*2, *n*3, *n*4, respectively (FIGS. 2 and 3).

As indicated in connection with FIG. 1, the value (e.g. 11111), of the first lateral-feed control signal need not be reserved for setting maximum motor speed, in contrast to the values of the first lateral-control signal which is reserved exclusively for indicating that the maximum permissible motor speed is going to be set. Of course, this applies only to the illustrated embodiment; for example, the feed-control-signal outputs of memory 3 could be used for the maximum-speed-establishing signals and be connected to the inputs of 3*a*, with the lateral-control-signal outputs of memory 3 then used for the maximum-permissible-speed signal and connected to the inputs of latch 5 — i.e., the reverse of the illustrated embodiment —, in which case one value of the feed-control signal (e.g., 11111) would be reserved for use as the maximum-speed-establishment signal.

In any event, the "1" pulse at the output of A3, as indicated above, has caused the latch 5 to latch in four of the bits of the first five-bit feed-control signal from memory 3, constituting the maximum-permissible-speed signal. This signal will be persistently applied to speed limiter 7 until such time as a different pattern is selected. When the operator depressed footpedal speed controller 6 to control motor speed, speed limiter 7 will limit the motor speed which can actually be achieved, in correspondence to the signal registered by latch 5.

The "1" signal at the output of A3, besides activating latch 5, is also applied to the input of the time-delay stage TD. The latter applies a brief clock pulse to the clock input of binary counter BC, via OR-gate OR2 and AND-gate A1. As a result, the count on BC moves up one step, from 000000 to 000001. The purpose of TD is to slightly delay the advancement of counter BC from 000000 to 000001, to assure that the second address signal is not furnished to memory 3 until after the first five-bit feed-control signal can be registered by latch 5.

With the count on counter BC now at 000001, the second address signal applied to the eight inputs of static memory 3 will be constituted by the two pattern-indicating signals furnished by encoder E, plus the counter output signal 000001. The lateral-control and feed-control information registered in the static-memory storage unit associated with this second address signal will be presented as second lateral-control and second feed-control signals at the output of memory 3 and be applied to the control solenoids 101–105 and 111–115. Depending upon the value of the lateral-control signal, the control solenoids 101–105 will set the zig-zag control arm CA (FIG. 5) for lateral needle movement of corresponding direction and amplitude. For example, the values of the lateral control signal may range from 0 to 30 (00000 to 11110), with the value 0 (00000) corresponding to maximum rightward needle shift, the value 15 (01111) corresponding to no lateral needle shift, values intermediate 0 and 15 (intermediate 00000 and 01111) corresponding to intermediate amounts of rightward needle shift, the value 30 (11110) corresponding to maximum leftward needle shift, and values intermediate 15 and 30 (01111 and 11110) corresponding to intermediate amounts of leftward needle shift.

Depending upon the value of the feed-control signal, the control solenoids 111–115 will set the feed control arm 12 for cloth feeding movement of corresponding direction and amplitude. For example, the values of the feed-control signal may range from 0 to 30 (00000 to 11110), with the value 0 (00000) corresponding to fifteen units of forward feed motion, the value 15 (01111) corresponding to zero feed motion, values intermediate 0 and 15 (intermediate 00000 and 01111) corresponding to intermediate amounts of forward feed motion, the value 30 (11110) corresponding to fifteen units of backward feed motion, and values intermediate 15 and 30 (intermediate 01111 and 11110) corresponding to intermediate amounts of backward feed motion.

With the drive solenoids 101–105 and 111–115 now having set the zig-zag control arm CA and the feed control arm 12 to settings corresponding to the directions and amplitudes of needle shift and work feed movement indicated by the second lateral-control and feed-control signals from static memory 3, the machine is readied for sewing of the selected pattern. When, now the operator depresses the footpedal speed controller 6 to initiate motor operation, the first stitch of the pattern will be sewn. The upper shaft US of the machine turns, shaft synchronizer 10 furnishes a clock pulse to binary counter BC, and the third addressing signal is furnished to memory 3, causing the second stitch of the pattern to be sewn.

When binary counter BC reaches count 111111, this is detected by AND-gate A2 which immediately resets counter BC to count 000000, and the entire cycle of operations described above is performed anew. Of course, now, when the maximum-speed-establishment and maximum-permissible-speed signals (the first lateral-control and feed-control signals) are generated this time, they are so briefly applied to control solenoids 9 as to have no effect upon the latter.

In the embodiment of FIG. 4, for the sake of simplicity only, just one resetting AND-gate A2 is used, indicating that each of the four selectable patterns has the same number of stitches. In practice, the different patterns will usually have different numbers of stitches; in that case, one would provide a different resetting AND-gate A2 for each different number of stitches in the selectable patterns, and when a pattern is selected only the associated resetting AND-gate would be connected into the circuit.

The speed limiting circuit 7 of FIG. 4 is shown in FIGS. 2*a* and 3*a*, in two different versions corresponding to the speed-limiting actions depicted in FIGS. 2 and 3.

In FIG. 2*a* showing the speed limiting circuit, a potentiometer P is connected across a voltage source VS. The potentiometer wiper is coupled to the footpedal speed controller 6. The wiper voltage of the potentiometer is applied to a multi-value limiting circuit comprised of a resistor R, a diode D1, four reference voltage sources VR1-VR4 and four associated electronic switches ES1-ES4. The output of the multi-value limiting circuit is applied to a power amplifier PA which enargizes the sewing machine motor 8.

The operation of the speed limiting circuit of FIG. 2*a* is as follows:

The maximum-permissible-speed signal latched onto the outputs of latch circuit 5 renders conductive one of electronic switches ES1–ES4, for example ES2. This causes second reference voltage source VR2 to become connected in series with diode D1; the other reference voltage sources VR1, VR3, VR4, can then be considered absent. With switch ES2 now conductive, voltage-limiting circuit R, D1, ES2, VR2, limits the value of the transmittable voltage to the voltage of VR2 plus an additional component corresponding to the anode-cathode voltage of D1, which latter can be neglected for simplicity.

With the footpedal undepressed, the potentiometer wiper is at its lowest-voltage setting and motor 8 is not energized. As the footpedal is progressively depressed, the wiper slides up the potentiometer resistor and the voltage applied to power amplifier PA rises correspondingly. When this voltage reaches the value associated with VR2, it cannot rise substantially higher, even if the footpedal continues to be depressed further.

FIG. 3*a* depicts a speed limiting circuit embodying the action depicted in FIG. 3. It is comprised of a potentiometer P whose wiper is coupled to the footpedal speed controller 6. Here, the potentiometer wiper does not select speed directly, but instead the percentage (between 0% and 100%) of the maximum permissible speed for the chosen pattern. The voltage applied across the resistor of potentiometer P is derived from a voltage divider R1-R4 connected across a voltage source VS. Electronic switches ES1–ES4 connect the upper terminal of potentiometer P to the upper terminal of voltage divider resistor R1, R2, R3 or R4, depending upon which of the electronic switches ES1–ES4 is rendered conductive by latch 5. In contrast to FIG. 2*a*, in FIG. 3*a*, no matter which maximum permissible speed is established, the range of effective speed-changing movement of the footpedal controller 6 will be the same.

It is to be understood that the embodiments described above are merely exemplary, and many modifications can be made. As indicated above, the maximum-speed-establishment signal received by AND-gate 3A (FIG. 4) could be derived from the feed-control-signal outputs of memory 3, with the maximum-permissible-speed signal received by latch 5 being derived from the lateral-control-signal outputs of memory 3.

The addressing circuit 2 (FIG. 4) is essentially comprised of a binary counter BC, but addressing expedients not utilizing counters can also be used.

In the illustrated embodiments, a maximum permissible speed is established for the entire pattern. In principle, however, different maximum permissible speeds could be established for different successive portions of the pattern, where the configuration of the pattern and the number of stitches therein justifies that. In general the speed of the sewing machine motor is limited as a function of the information furnished at the lateral- and feed-control-signal outputs of the static memory 3.

It would also be possible to derive the maximum-speed-establishment signal and the maximum-permissible-speed signal from just the feed-control-signal outputs of memory 3, or else from just the lateral-control-signal outputs of memory 3, if the number of such outputs is sufficient for the number of selectable patterns.

Likewise, if the lateral-control and feed-control signals were to be furnished serially, not parallel, the inventive concept would still be applicable.

In the illustrated embodiment, both the maximum-speed-establishment signal and the maximum-permissible-speed signal are generated simultaneously, in response to the first address signal applied to memory 3. However, the maximum-speed-establishment signal and the maximum-permissible-speed signal could be generated successively, in response to successive address signals.

Many other such modifications of the information flow of the embodiment of FIG. 4 are possible, and fall within the scope of the inventive concepts.

Also, whereas the speed-limiting circuits of FIGS. 2*a* and 3*a* are analog in operation, equivalent digital circuitry could be used.

It will be understood that each of the elements described above, or two or more together, may also find a useful application in other types of circuits and constructions differing from the types described above.

While the invention has been illustrated and described as embodied in a particular sewing machine structural context, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a sewing machine, in combination, a sewing needle mounted for reciprocatory penetration into work being sewn and also mounted for lateral shifting movement; a drive motor reciprocating the needle; motor-control means for controlling the operation of the drive motor; lateral-control means for controlling the lateral shifting movement of the needle; work-feeding means for feeding work to the sewing needle; feed-control means for controlling the operation of the work-feeding means; a static memory storing pattern information representing the stitches in a plurality of different multi-stitch stitching patterns and also motor-speed-control information for the different stitching patterns; pattern selecting means for selecting the stitching pattern to be sewn; information-transmitting means responsive to the pattern selection for transmitting from the static memory to the lateral-control means and the feed-conrol means the pattern information associated with the selected pattern and for transmitting from the static memory to the motor-control means the motor-speed-control information associated with the selected pattern.

2. The sewing machine defined in claim 1, the motor-speed-control information stored in the static memory comprising maximum-permissible-speed information for the different stitching patterns, the motor-control means comprising means for limiting the speed of the drive motor in dependence upon the maximum-permissible-speed information transmitted thereto.

3. The sewing machine defined in claim 1, the maximum-permissible-speed information stored by the static memory consisting of information representing a single respective maximum motor speed for each of the different stitching patterns.

4. The sewing machine defined in claim 1, the motor-speed-control information stored in the static memory comprising maximum-permissible-speed information for the different stitching patterns, the motor-control means comprising speed-selecting means activatable by the user of the machine for selecting motor speeds and also speed-limiting means operative in dependence upon the maximum-permissible-speed information for preventing the speed-selecting means from establishing motor speeds greater than that represented by the maximum-permissible-speed information.

5. The sewing machine defined in claim 4, the speed-selecting means having a range of settings corresponding to different motor speeds, the speed-limiting means comprising means operative in dependence upon the maximum-permissible-speed information for overriding the action of the speed-selecting means when the latter assumes settings corresponding to speeds in excess of that represented by the maximum-permissible-speed information.

6. The sewing machine defined in claim 4, the speed-selecting means having a range of settings corresponding to different fractions of maximum motor speed, the speed-limiting means comprising means responsive to the maximum-permissible speed information for changing the motor speeds associated with each setting of the speed-selecting means without changing the fractions of maximum motor speed associated with the settings.

7. The sewing machine defined in claim 1, the pattern information stored by the static memory comprising lateral-control information representative of the lateral shift to be imparted to the sewing needle and feed-control information representative of the work feed movement to be effected by the work-feeding means, the static memory having lateral-control-signal and feed-control-signal outputs respectively connected to the lateral-control means and the feed-control means for transmission of the lateral-control and feed-control information thereto, the information-transmitting means comprising means responsive to the pattern selection for transmitting the motor-speed-control information via the control signal outputs of the static memory.

8. The sewing machine defined in claim 7, the motor-speed-control information stored in the static memory comprising maximum-permissible-speed information for the different stitching patterns, the motor-control means comprising speed-limiting means connected to the lateral-control-signal and feed-control-signal outputs of the static memory and operative in dependence upon the maximum-permissible-speed information transmitted thereto for correspondingly limiting the speed of the motor.

9. The sewing machine defined in claim 8, the static memory having a plurality of lateral-control-signal outputs constituting a first set of outputs and a plurality of feed-control-signal outputs constituting a second set of outputs, the speed-limiting means comprising latch means having inputs connected to one set of outputs of the static memory for receiving the control signals transmitted thereon but operative for registering such control signals only when the latch means is activated, detecting means having inputs connected to the other set of outputs of the static memory for receiving the control signals transmitted thereon and operative in response to a particular value of such control signal for activating the latch means, and a speed-limiting circuit having input means connected to the latch means for limiting the speed of the motor in dependence upon the control signal registered by the latch means.

10. The sewing machine defined in claim 1, the pattern information stored by the static memory comprising lateral-control signals and feed-control signals representative of the lateral shift to be imparted to the sewing needle and the work feed movement to be effected by the work-feeding means, respectively, the static memory having a set of lateral-control-signal outputs and a set of feed-control-signal outputs respectively connected to the lateral-control means and the feed-control means for transmission of the lateral-control and feed-control signals thereto, one of the lateral-control signals stored by the static memory having a predetermined value and constituting a maximum-speed-establishment signal indicating that the maximum motor speed for the selected pattern is to be established, the stored feed-control signals associated with the different patterns each including one feed-control signal having a predetermined value and constituting a maximum-permissible-speed signal for the respective pattern, the motor-control means comprising a latch circuit having inputs connected to the lateral-control-signal outputs of the static memory for receiving the lateral-control signals therefrom but registering such signals only when activated, a detector having inputs connected to the feed-control-signal outputs of the static memory for receiving the feed-control signals therefrom and operative in response to the maximum-speed-establishment signal for activating the latch to cause the latter to register the maximum-permissible-speed signal associated with the selected pattern, and a speed-limiting circuit connected to the drive motor and operative for limiting drive motor speed in dependence upon the maximum-permissible-speed signal registered by the latch circuit.

11. The sewing machine defined in claim 1, the information-transmitting means comprising addressing means operative in dependence upon the pattern selecting means for repeatedly applying to the static memory a predetermined sequence of address signals causing the static memory to produce a repeated sequence of lateral-control signals at its lateral-control-signal outputs and a repeated sequence of feed-control signals at its feed-control-signal outputs, the first lateral-control signal in the sequence associated with any of the patterns being the maximum-speed establishment signal, the first feed-control signal in the sequence associated with any of the patterns being the respective maximum-permissible-speed signal.

* * * * *